US011136159B2

(12) United States Patent
Waltemyer et al.

(10) Patent No.: US 11,136,159 B2
(45) Date of Patent: Oct. 5, 2021

(54) CONTAINER WITH VACUUM RESISTANT RIBS

(71) Applicant: GRAHAM PACKAGING COMPANY, L.P., Lancaster, PA (US)

(72) Inventors: Robert Waltemyer, Felton, PA (US); Shannon K. Sprenkle, York, PA (US); Justin A. Howell, Mechanicsburg, PA (US); Michael (MT) T. Kelly, Manchester, PA (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 642 days.

(21) Appl. No.: 16/040,183

(22) Filed: Jul. 19, 2018

(65) Prior Publication Data

US 2020/0024022 A1 Jan. 23, 2020

(51) Int. Cl.
*B65D 1/02* (2006.01)
*B65D 1/44* (2006.01)
*B65D 81/02* (2006.01)

(52) U.S. Cl.
CPC ..... *B65D 1/0223* (2013.01); *B65D 1/44* (2013.01); *B65D 81/02* (2013.01); *B65D 2501/0036* (2013.01)

(58) Field of Classification Search
CPC ..... B65D 1/02; B65D 1/0223; B65D 1/44; B65D 2501/0036; B65D 2501/0027; B65D 2501/0018; B65D 69/005; B65D 69/008

(Continued)

(56) References Cited

U.S. PATENT DOCUMENTS 5,746,339 A 5/1998 Petre et al.
5,988,417 A * 11/1999 Cheng ..... B65D 1/0223 215/373

(Continued)

FOREIGN PATENT DOCUMENTS

WO WO 2001/081821 A1 11/2001

OTHER PUBLICATIONS

U.S. Appl. No. 29/634,181, filed Jan. 18, 2018.

(Continued)

*Primary Examiner* — Anthony D Stashick
*Assistant Examiner* — Elisabeth Sullivan
(74) *Attorney, Agent, or Firm* — Stradley Ronon Stevens & Young, LLP

(57) ABSTRACT

Container having a body portion with sidewall defining outer perimeter and hollow interior. The body portion includes a plurality of continuous ribs extending about the outer perimeter of the sidewall, each rib having alternating horizontal segments and branched segments. Each branched segment includes a top branch and bottom branch joined at either end to define a bounded area therebetween. The plurality of continuous ribs includes at least a first continuous rib and second continuous rib spaced vertically from the first continuous rib. A midpoint of each branched segment of the first continuous rib is aligned along a vertical axis with a midpoint of a corresponding horizontal segment of the second continuous rib, and a midpoint of each horizontal segment of the first continuous rib is aligned along a vertical axis with a midpoint of a corresponding branched segment of the second continuous rib.

21 Claims, 12 Drawing Sheets

(58) Field of Classification Search
USPC ..... 215/238, 371, 379, 381, 382, 383, 384, 215/375, 376; 220/605, 606, 608, 609
See application file for complete search history.

(56) References Cited

U.S. PATENT DOCUMENTS

| | | | | |
|---|---|---|---|---|
| D429,151 | S | 8/2000 | Cheng et al. | |
| 6,929,138 | B2 | 8/2005 | Melrose et al. | |
| 7,032,770 | B2 | 4/2006 | Finlay et al. | |
| D522,874 | S | 6/2006 | Livingston et al. | |
| D526,906 | S | 8/2006 | Yorn et al. | |
| D567,095 | S | 4/2008 | Miller | |
| D576,050 | S | 9/2008 | Darr et al. | |
| D576,496 | S | 9/2008 | Darr et al. | |
| D582,781 | S | 12/2008 | Miller | |
| D596,040 | S | 7/2009 | Lepoitevin | |
| D614,039 | S | 4/2010 | Arnell | |
| 7,731,044 | B2 | 6/2010 | Boukobza | |
| D619,011 | S | 7/2010 | Zoppas | |
| D621,270 | S | 8/2010 | Arnell | |
| 8,091,720 | B2 | 1/2012 | Colloud | |
| D670,562 | S | 11/2012 | Lembke | |
| 8,561,822 | B2 | 10/2013 | Beck et al. | |
| D719,033 | S | 12/2014 | Kaddari | |
| D740,129 | S | 10/2015 | Martin et al. | |
| D749,954 | S | 2/2016 | Darr | |
| 9,403,625 | B2 * | 8/2016 | Lembke | B65D 1/0276 |
| D833,880 | S | 11/2018 | Barel | |
| 2003/0010743 | A1 * | 1/2003 | Boukobza | B65D 1/0223 215/382 |
| 2004/0149677 | A1 * | 8/2004 | Slat | B65D 1/0276 215/380 |

OTHER PUBLICATIONS

U.S. Appl. No. 29/634,181, filed Jan. 4, 2019 Non-Final Office Action.

International Search Report and Written Opinion dated Oct. 11, 2019 in International Application No. PCT/US2019/042512.

* cited by examiner

CONTAINER WITH VACUUM RESISTANT RIBS

BACKGROUND

Field of the Disclosed Subject Matter

The presently disclosed subject matter relates generally to plastic containers, for example a blow-molded bottle with ribs.

Description of Related Art

Plastic containers are often used due to their durability and lightweight nature. A wide variety of suitable plastics are commercialized for various uses. For example, polyethylene terephthalate (PET) is often used to form containers, which are lightweight, inexpensive, recyclable and manufacturable in large quantities.

Plastic containers can be used for a variety of products, such as perishable beverages and nonperishable liquids. Often these beverages, such as juices and isotonics, are filled into the containers while the liquid is at an elevated temperature. Subsequently the container is sealed and allowed to cool. This process is known as hot-filling. The containers that are designed to withstand the process are known as hot-fill containers.

The use of blow molded plastic containers for packaging hot-fill beverages is well known. However, a plastic container that is used in the hot-fill process is subject to stresses on the container that can result in the container deforming or failing due to the pressure differential (i.e. vacuum) created by the cooled liquid. Furthermore, the deformation of the container, if not controlled, can detrimentally impact the strength of the container, e.g. hoop strength about the circumference and/or axial load strength.

A variety of techniques and features have been developed to minimize or control deformation resulting from the hot-fill process. Such techniques include incorporation of vacuum panels into the sidewall of the container and/or a diaphragm-like feature or construction in the base of the container. However, there continues to be a need for improved techniques or features to address the pressure-differentials resulting from the hot-fill process in blow-molded plastic containers without compromising the aesthetics or strength of the container.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages, and in accordance with the purpose of the disclosed subject matter, as embodied and broadly described, the disclosed subject matter includes a container having a body portion with a sidewall defining an outer perimeter and a hollow interior. The container further includes a bottom portion extending from a lower end of the body portion, the bottom portion defining a horizontal support surface. The container further includes a top portion extending from an upper end of the body portion opposite the bottom portion. The top portion includes a finish portion. The body portion of the container includes a plurality of continuous ribs extending about the outer perimeter of the sidewall, each continuous rib having alternating horizontal segments and branched segments. Each branched segment includes a top branch and a bottom branch joined at either end to define a bounded area therebetween. The plurality of continuous ribs includes at least a first continuous rib and a second continuous rib, the second continuous rib spaced vertically from the first continuous rib. A midpoint of each branched segment of the first continuous rib is aligned along a vertical axis with a midpoint of a corresponding horizontal segment of the second continuous rib, and a midpoint of each horizontal segment of the first continuous rib is aligned along a vertical axis with a midpoint of a corresponding branched segment of the second continuous rib.

Additionally, and as embodied herein, for purpose of illustration and not limitation, a top edge of each top branch of the first continuous rib can define a first horizontal plane, and a bottom edge of each bottom branch of the second continuous rib can define a second horizontal plane. The second horizontal plane can be spaced vertically from the first horizontal plane. For example, the second horizontal plane can be above the first horizontal plane. Furthermore, the body portion can include a continuous groove extending about the outer perimeter of the sidewall between the first horizontal plane and the second horizontal plane. The distance between the first horizontal plane and the second horizontal plane can be approximately 0.040 inches to approximately 0.090 inches.

Furthermore, and as embodied herein, the first continuous rib and second continuous rib can be configured such that a first vertical distance between a midpoint of each top branch of the first continuous rib and a midpoint of a corresponding horizontal segment of the second continuous rib is substantially equal to a second vertical distance between a midpoint of each horizontal segment of the first continuous rib and a midpoint of a corresponding bottom branch of the second continuous rib. The first vertical distance can be approximately 0.280 inches to approximately 0.420 inches.

Additionally, and as embodied herein, the container can include a third continuous rib such that a first vertical distance between a midpoint of each horizontal segment of the second continuous rib and a midpoint of a corresponding top branch of the first continuous rib can be substantially equal to a second vertical distance between the midpoint of each horizontal segment of the second continuous rib and a midpoint of a corresponding bottom branch of the third continuous rib. Although not limited, the body portion of the container can include between 3 and 12 continuous ribs.

Further in accordance with the disclosed subject matter, each bounded area can have any of a variety of suitable shapes, such as a circular shape, oval shape, eye-like shape, rectangular shape, square shape, hexagonal shape, octagonal shape or any other suitable shape. As embodied herein, each branched segment can include at least one linear section aligned parallel to each horizontal segment. The length of each linear section can be substantially equal to a length of each horizontal segment. Although not limited, each continuous rib can have between 4 and 12 branched segments and a corresponding number of horizontal segments.

As further embodied herein, and in accordance with the disclosed subject matter, each continuous rib defines a concave channel in side cross-section relative to an exterior of the perimeter. Each channel can have a nadir having a first depth relative to the sidewall. For example, the first depth can be between 0.020 inches and 0.080 inches. Furthermore, and as embodied herein, each nadir can have a second depth relative to the bounded area. The second depth can be substantially equal to the first depth or can differ from the first depth.

Further in accordance with the disclosed subject matter, the container is a blow molded container. As embodied herein, the container can have a wall thickness of approximately 0.008 inches to approximately 0.017 inches. Additionally, or alternatively, the container can have a total weight of approximately 24 grams to approximately 35 grams. Containers in accordance with the disclosed subject matter can be made from any suitable material, such as low and high-density polyethylene, polyethylene terephthalate, polyethylene naphthalate ("PEN"), PEN blends, polyvinyl chloride, polypropylene, polystyrene, fluorine treated high density polyethylene, post-consumer resin, K-resin, bioplastic, catalytic scavengers, including monolayer-blended scavengers, multi-layer structures, or a mixture, blend, or copolymer thereof. Furthermore, and as embodied herein, the bottom portion of the container can include a vacuum base.

The disclosed subject matter also includes a method of making a container having some or all of the features described herein, as well as a method of using such a container. As recognized in the art, the container disclosed herein can include some or all of the features described herein, or any suitable combination thereof.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the containers and methods of the disclosed subject matter. Together with the description, the drawings serve to explain the principles of the disclosed subject matter.

DETAILED DESCRIPTION

Figure 1:
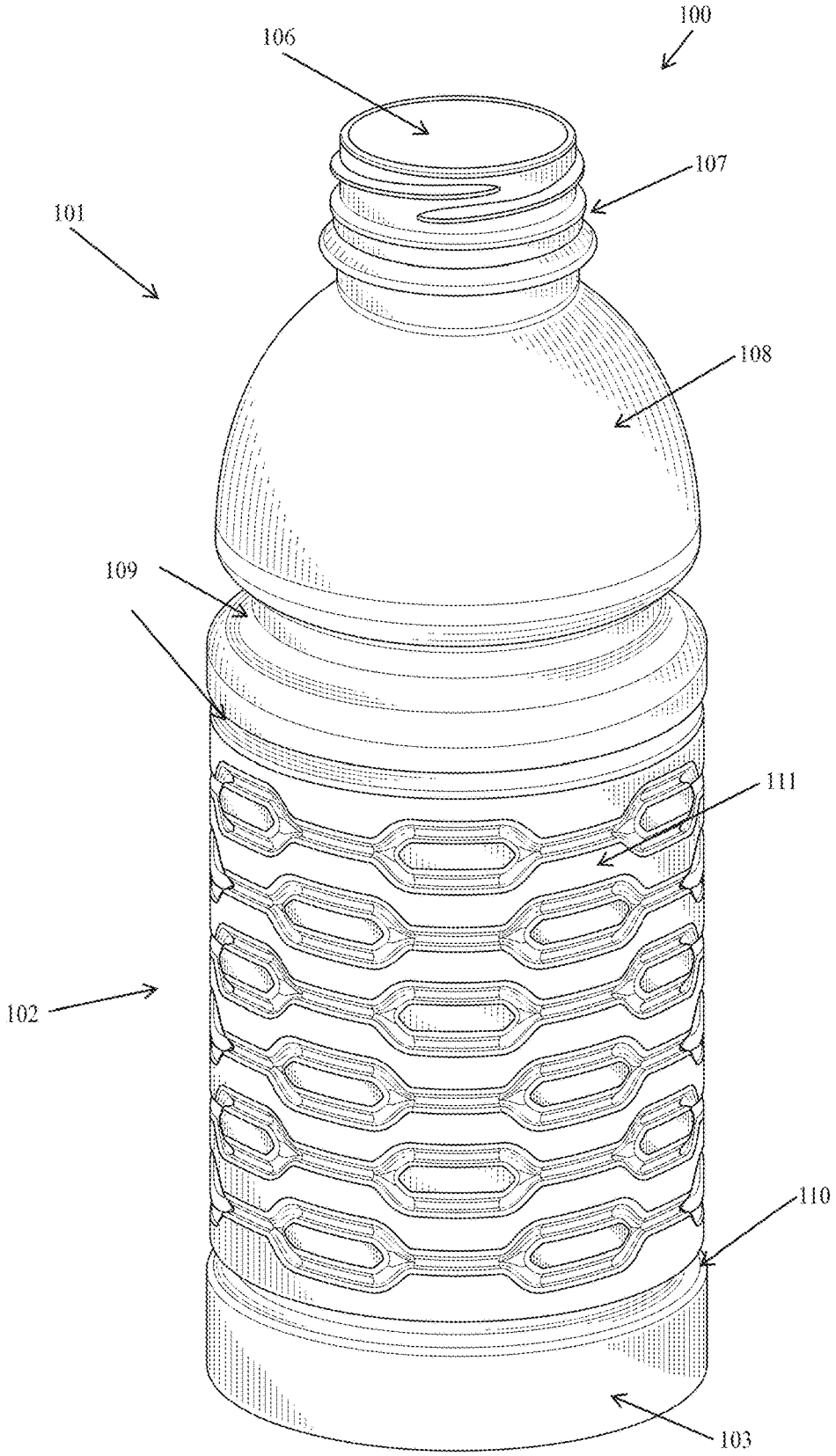
FIG. 1 is a perspective view of an exemplary embodiment of a container in accordance with the disclosed subject matter.

Reference will now be made in detail to the various exemplary embodiments of the disclosed subject matter, exemplary embodiments of which are illustrated in the accompanying drawings. The structure and corresponding method of operation of the disclosed subject matter will be described in conjunction with the detailed description of the system.

The apparatus and methods presented herein can be used for the packaging, transport, storage, commercialization, and consumption of a wide variety of perishable or nonperishable liquids and other products. The disclosed subject matter is particularly suited for blow-molded plastic containers subject to hot-fill processes or the like.

In accordance with the disclosed subject matter herein, the container generally includes a body portion with a sidewall defining an outer perimeter and a hollow interior. The container further includes a bottom portion extending from a lower end of the body portion, the bottom portion defining a horizontal support surface. The container further includes a top portion extending from an upper end of the body portion opposite the bottom portion. The top portion includes a finish portion. The body portion of the container includes a plurality of continuous ribs extending about the outer perimeter of the sidewall, each continuous rib having alternating horizontal segments and branched segments. Each branched segment includes a top branch and a bottom branch joined at either end to define a bounded area therebetween. The plurality of continuous ribs includes at least a first continuous rib and a second continuous rib, the second continuous rib spaced vertically from the first continuous rib. A midpoint of each branched segment of the first continuous rib is aligned along a vertical axis with a midpoint of a corresponding horizontal segment of the second continuous rib, and a midpoint of each horizontal segment of the first continuous rib is aligned along a vertical axis with a midpoint of a corresponding branched segment of the second continuous rib.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, exemplary embodiments of the container in accordance with the disclosed subject matter are shown in FIGS. 1-11C. The container of the disclosed subject matter is suitable for use with a wide variety of liquids. As used herein, the terms "front," "rear," "side," "top," and "bottom" are used for the purpose of illustration only, and not limitation. That is, it is recognized that the terms "front," "rear," "side," "top," and "bottom" are interchangeable and are merely used herein as a point of reference.

Figure 2:
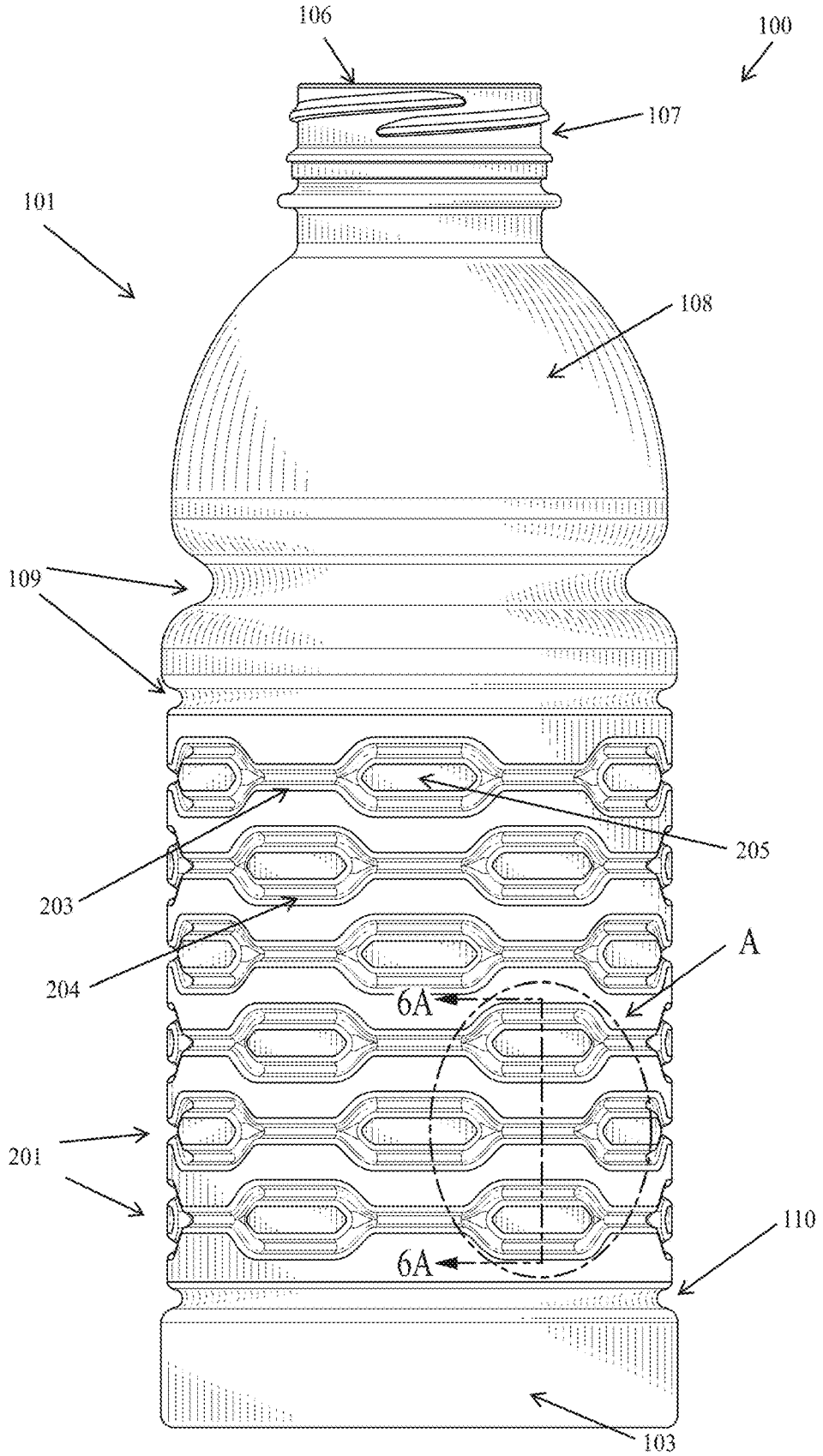
FIG. 2 is a side view of the container of FIG. 1.
Figure 3:
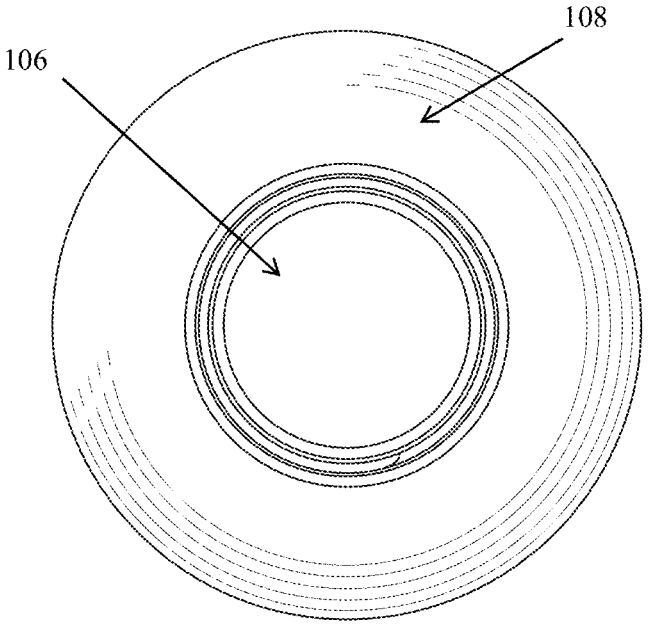
FIG. 3 is a top view of the container of FIG. 1.

For purpose of illustration, and not limitation, reference is made to the exemplary embodiment of a container 100 shown in FIGS. 1-6B. As shown in FIGS. 1 and 2, container 100 generally includes a body portion 102, a top portion 101 disposed above the body portion 102 and extending from an upper end of the body portion 102, and a bottom portion 103 disposed below body portion 102 opposite top portion 101 and extending from a lower end of the body portion. Top portion 101 can include a finish portion 107 defining an opening 106 to the interior of container 100. Finish portion 107 can include an engagement or fastener for a closure to cover opening 106. Finish portion 107 can include any suitable engagement for a container closure, for example and without limitation, an internal or external threaded engagement, neck-time and lever wire engagement, non-threaded cap engagement, groove-ring wax seal, or any other suitable container closure engagement. Top portion 101 can further include a dome or other feature extending from the body portion 102. For example, and as embodied herein, dome 108 can extend radially outward and downward from finish portion 107, and can have a contoured shape, such as a partial spherical or parabolic shape. Furthermore, top portion 101 can include a plurality of segments or fluting to define and strengthen the contoured shape. Additionally, and as embodied herein, container 100 can include one or more grooves 109 or other features which can define a transition between top portion 101 and body portion 102. The one or more grooves 109 can extend horizontally about the outer circumferential perimeter of the top portion 101 and body portion 102, such as continuous groove 109 as embodied herein. Similarly, container 100 can include one or more grooves 110 or other features which can define a transition between body portion 102 and bottom portion 103. The one or more grooves 110 can extend horizontally about the outer circumferential perimeter of the bottom portion 103 and body portion 102, such as continuous groove 110 as embodied herein.

Body portion 102 can extend from top portion 101 directly or indirectly and include sidewall 111. In accordance with the disclosed subject matter, and as embodied herein, body portion 102 can include a plurality of continuous ribs 201, each extending continuously about the outer perimeter of the sidewall 111. Each continuous rib 201 includes branched segments 204 which define the bounded areas 205 of body portion 102, as further discussed herein.

Body portion 102 can have any of a variety of suitable shapes. For example, and without limitation, body portion 102 can have a generally polygonal shape in plan view, such as a rectangular, square or octagonal shape, or an elliptical shape, or as embodied herein, body portion 102 of container 100 can have a substantially circular shape in plan view. Such shapes can be readily manufactured using blow-molding techniques and compatible for use with certain equipment used for sterilization and/or pasteurization, such as a high-pressure processing (or high-pressure preservation or HPP) food processing apparatus.

As previously noted and as embodied herein, body portion 102 can include a plurality of continuous ribs 201 which can strengthen the container while controlling or inhibiting distortion and/or deflection of the body portion 102, for example due to negative pressure in the container, such as for gripping, lifting or manipulating of the container. Container 100 can include any suitable number of continuous ribs. As embodied herein, continuous ribs 201 can extend horizontally about the outer perimeter of the sidewall 111 of the body portion 102. Each continuous rib can include alternating horizontal segments 203 and branched segments 204. In accordance with the disclosed subject matter, each continuous rib 201 can include any suitable number of branched segments 204 and a corresponding number of horizontal segments 203. The number of branched segments 204 and corresponding number of horizontal segments 203 in each continuous rib 201 can depend on the size and shape of the container, as well as on the size and shape of the branched segments 204 and horizontal segments 203 respectively. For example, and without limitation, for a container with a capacity of 20 fluid ounces or a diameter of approximately 2.9 inches, each continuous rib 201 can have between 5 and 9 branched segments 204 and a corresponding number of horizontal segments. In accordance with one aspect of the disclosed subject matter, the container can have 6 branched segments 204 and a corresponding number of horizontal segments 203.

Figure 5:
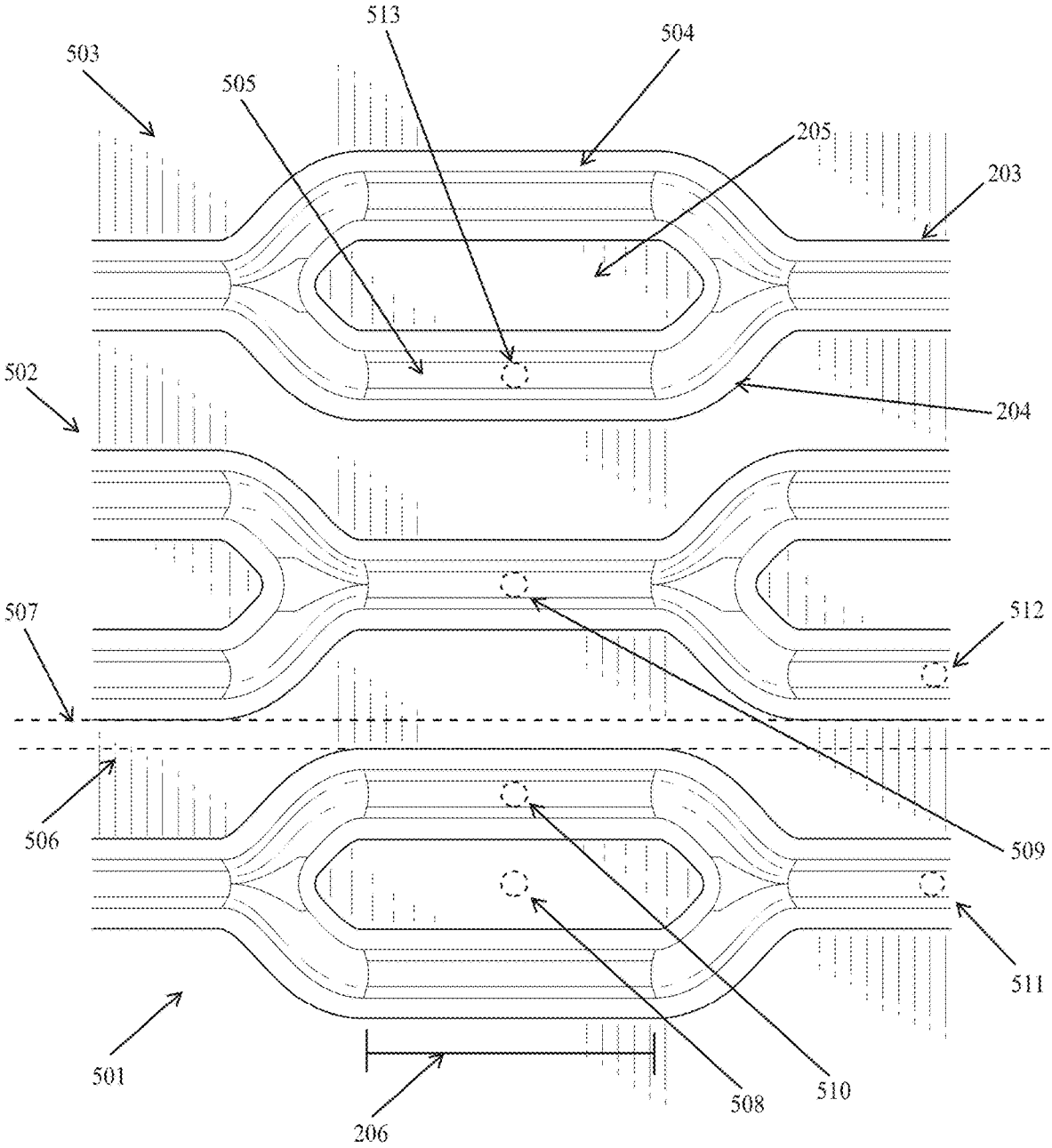
FIG. 5 is a detail side view of a portion of the container of FIG. 1 as indicated by dashed line A as referenced in FIG. 2.

With reference to FIG. 5, each branched segment 204 includes a top branch 504 and a bottom branch 505. The top branch 504 and bottom branch 505 of each branched segment 204 can be joined at either end to define a bounded area 205 therebetween. That is, the bounded area 205 is a bounded surface area having a perimeter defined by the top branch 504 and the bottom branch 505 of each branched segment 204. As discussed further herein, this bounded surface area can be generally aligned with the sidewall 111 in plan view, or recessed relative the sidewall 111, or raised relative the sidewall 111. For example, and without limitation, each branched segment 204 can include at least one linear section 206 which can be aligned in parallel to each horizontal segment 203 as embodied herein. As shown in FIG. 5, each branched segment 204 can include two linear sections 206, each aligned in parallel to each horizontal segment 203. In this manner, and as embodied herein, the bounded area 205 can have a generally hexagonal shape.

Figure 11C:
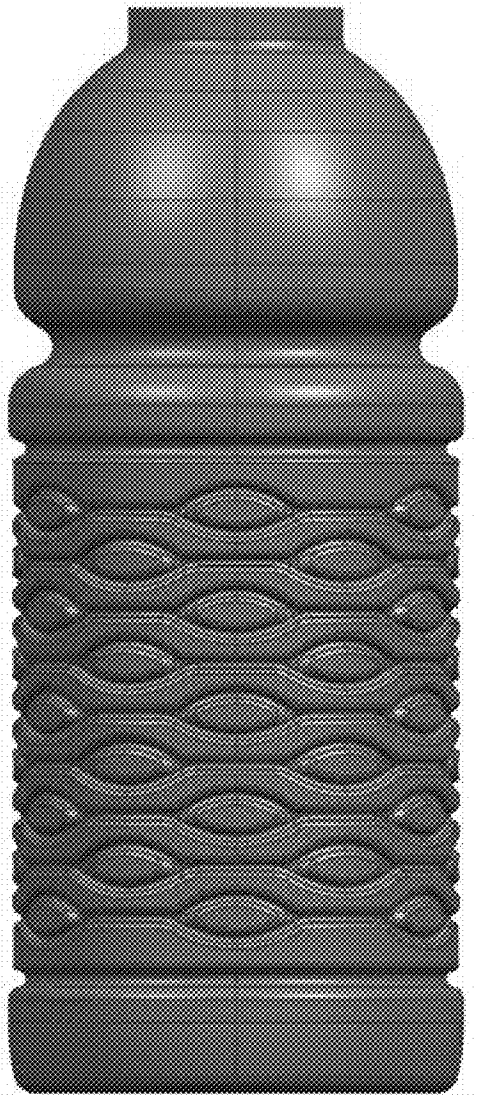
FIG. 11C is a side view of another exemplary embodiment of a container in accordance with the disclosed subject matter.

Alternatively, and in accordance with the disclosed subject matter, the bounded area 205 can be defined by a top branch 504 and a bottom branch 505 so as to have any of a variety of other suitable shapes. For example, and without limitation, bounded area 205 can have a generally oval shape, or a substantially rectangular shape, a triangular shape, an eye-like shape, a circular shape, a square shape, an octagonal shape, or any other suitable shape. For purpose of example and not limitation, an exemplary embodiment of a container in accordance with the disclosed subject matter with bounded areas 205 having an eye-like shape is depicted in FIG. 11C.

Figure 11B:
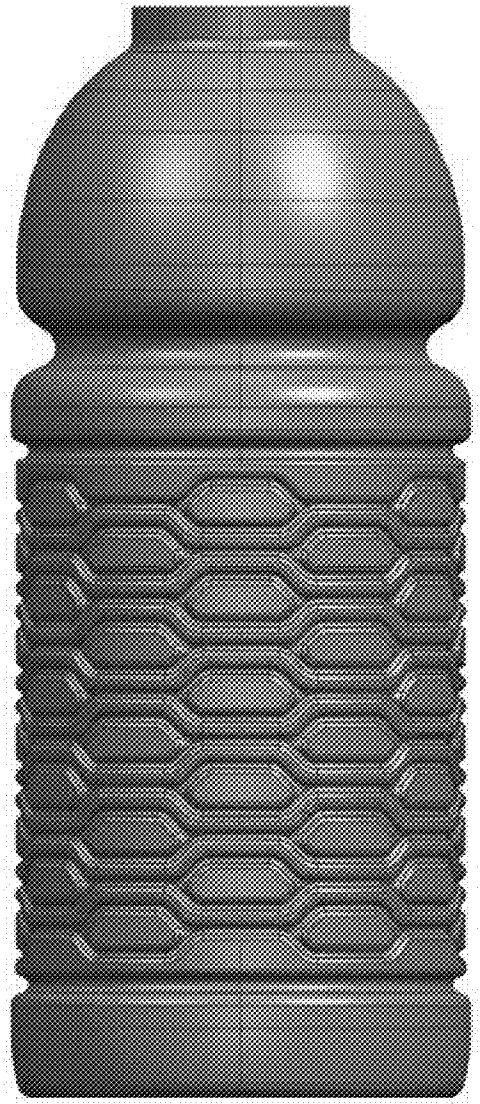
FIG. 11B is a side view of another exemplary embodiment of a container in accordance with the disclosed subject matter.
Figure 11A:
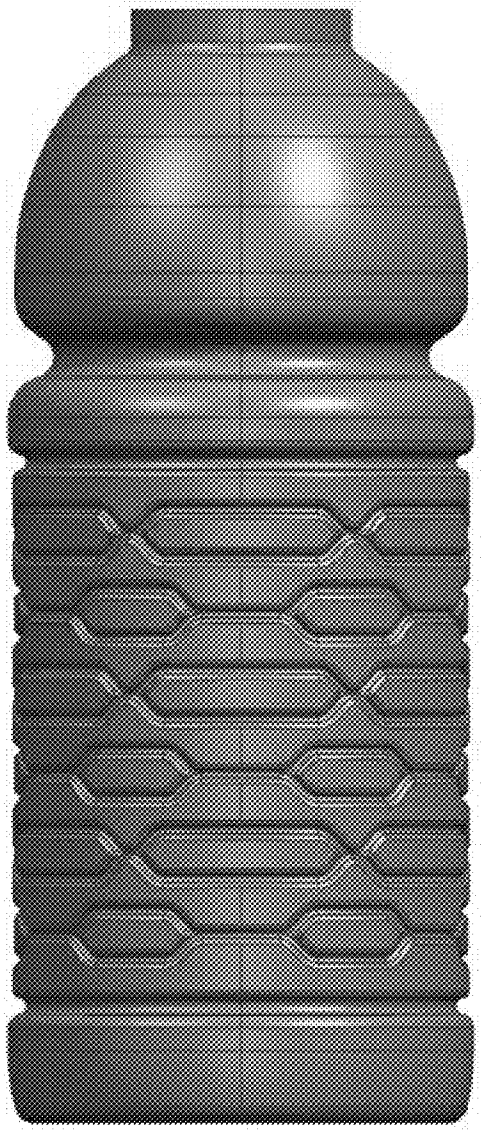
FIG. 11A is a side view of another exemplary embodiment of a container in accordance with the disclosed subject matter.

Additionally, or alternatively, and as further embodied herein, containers in accordance with the disclosed subject matter can include bounded areas 205 of different shapes and sizes. For purposes of example, and not limitation, a first continuous rib can have branched segments 204 defining bounded areas with a generally hexagonal shape, and a second continuous rib can have branched segments 204 defining bounded areas 205 having a generally oval shape. For purposes of example and not limitation, FIG. 11A depicts an exemplary embodiment of a container in accordance with the disclosed subject matter with bounded areas 205 having generally hexagonal shapes of different sizes.

Further referencing FIG. 5, at least a first continuous rib 501, a second continuous rib 502, and a third continuous rib 503 are depicted. As used herein, the terms "first," "second," and "third" are for the purpose of illustration only, and not limitation. That is, it is recognized that the terms "first," "second," and "third" are interchangeable and are merely used herein as a point of reference. As embodied herein, the first continuous rib 501 and the second continuous rib 502 can be spaced vertically from one another. For example, and as depicted in FIG. 5, the top edge of each top branch 504 of the first continuous rib 501 can define a first horizontal plane 506, and the bottom edge of each bottom branch 505 in the second continuous rib 502 can define a second horizontal plane 507. First horizontal plane 506 and second horizontal plane 507 are shown in FIG. 5 in dashed line for purpose of illustration only. As embodied in the container 100 of FIGS. 1-6, the second horizontal plane 507 can be spaced vertically from the first horizontal plane 506 such that the second horizontal plane 507 is above the first horizontal plane 506. That is, the second horizontal plane 507 can be disposed closer to the top portion 101 than the first horizontal plane 506. Furthermore, a continuous groove 710 can extend about the outer perimeter of the sidewall 111 in the space between the first horizontal plane 506 and second horizontal plane 507, as further discussed herein with respect to the exemplary embodiment of FIGS. 7-10.

Alternatively, depending on the desired use of the container 100, the second horizontal plane 507 can be spaced vertically from the first horizontal plane 506 such that the second horizontal plane 507 is below the first horizontal plane 506. That is, the second horizontal plane 507 can be disposed closer to the bottom portion 103 of the container 100 than the first horizontal plane 506, such that second continuous rib 502 can be closer to first continuous rib 501 along a vertical axis. For purpose of example, and not limitation, an alternative exemplary embodiment of a container in accordance with the disclosed subject matter having such a configuration is depicted in FIG. 11B. Whether the second horizontal plane 507 is disposed above or below the first horizontal plane 506, the distance between the first horizontal plane 506 and the second horizontal plane 507 can be any suitable distance and can be selected based on the intended use of the container and the number of continuous ribs 201 desired. The spacing between adjacent continuous ribs can impact the performance characteristics of the container 100. For example, areas of stress concentration, or stress risers, in the container sidewall can be created depending on the spacing configuration selected. In accordance with one aspect of the disclosed subject matter, the distance between the first horizontal plane 506 and the second horizontal plane 507 can be between approximately 0.040 inches and 0.090 inches. For purpose of example, and as embodied herein, the distance between the first horizontal plane 506 and the second horizontal plane 507 can be approximately 0.067 inches.

Depending on the desired performance and intended use of the container, the second horizontal plane 507 and the first horizontal plane 506 can be co-planer along a vertical axis such that a top edge of the top branch 504 of a first continuous rib 501 can be aligned with a bottom edge of a corresponding bottom branch 505 of a second continuous rib 502. For example, and with reference to the exemplary embodiment of FIG. 5, the first horizontal plane 506 and the second horizontal plane 507 would be in line with each other.

Further referencing FIG. 5, the first continuous rib 501 is aligned with the second continuous rib 502 such that a midpoint 508 of each branched segment 204 of the first continuous rib 501 is aligned along a vertical axis with a midpoint 509 of each corresponding horizontal segment 203 of the second continuous rib 502. As further embodied herein, the first continuous rib 501 can be spaced vertically from the second continuous rib 502 such that a first vertical distance can be measured between a midpoint 510 of each top branch 504 of the first continuous rib 501 and midpoint 509 of each corresponding horizontal segment 203 of the second continuous rib 502. In accordance with one aspect of the disclosed subject matter, the first distance between midpoint 510 and midpoint 509 can be approximately 0.280 inches to approximately 0.420 inches. For purpose of example, and as embodied herein, the first distance can be approximately 0.350 inches. A second vertical distance can also be measured between a midpoint 511 of each horizontal segment 203 of the first continuous rib 501 and a midpoint 512 of each corresponding bottom branch 505 of the second continuous rib 502. As embodied herein, the first vertical distance between midpoints 510 and 509 can be substantially the same as the second vertical distance between midpoints 511 and 512.

Additionally, and as further embodied herein, the container 100 can include a third continuous rib 503. The third continuous rib 503 can be vertically spaced from the second continuous rib 502 such that the vertical spacing between the third continuous rib 503 and the second continuous rib 502 can be substantially equal to the vertical spacing between the first continuous rib 501 and the second continuous rib 502. As such, a first vertical distance can be measured between a midpoint 509 of each horizontal segment 203 of the second continuous rib 502 and midpoint 510 of each corresponding top branch 504 of the first continuous rib 501, and further wherein a second vertical distance can be measured between a midpoint 509 of each horizontal segment 203 of the second continuous rib 502 and midpoint 513 of each corresponding bottom branch 505 of the third continuous 503. As embodied herein, the first vertical distance between midpoints 509 and 510 can be substantially the same as the second vertical distance between midpoints 509 and 513. Alternatively, the vertical spacing between the second and third continuous ribs can be different than the vertical spacing between the first and second continuous ribs.

As further depicted in the exemplary embodiment of FIGS. 1-6B, continuous ribs 201 can be aligned and vertically spaced with adjacent ribs in the manner described above such that a symmetrical offset pattern of continuous ribs 201 and bounded areas 205 is created along the body portion 102 of the container 100. While reference has been made to three continuous ribs, containers in accordance with the disclosed subject matter can include any suitable number of continuous ribs 201. For example, containers in accordance with the disclosed subject matter can include between 3 and 12 continuous ribs 201 depending on the size of the container and the desired vertical spacing between continuous ribs 201. Additionally, and as further embodied herein, different vertical spacing can be selected between different pairs of adjacent continuous ribs 201. For example, and as discussed further herein, the container 700 can include one or more continuous grooves 710 which can extend about the outer perimeter of the sidewall 111 between one or more continuous ribs 210.

Figure 8:
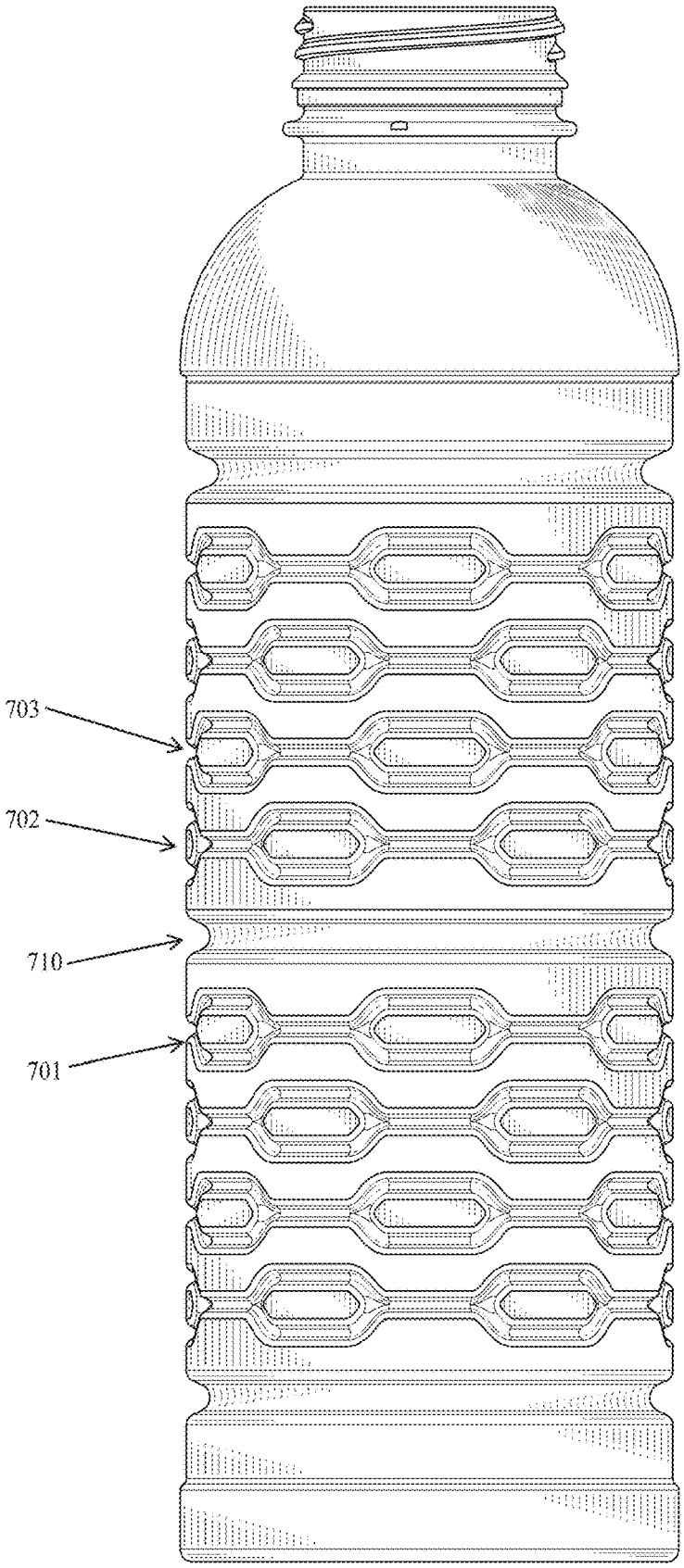
FIG. 8 is a side view of the container of FIG. 7.
Figure 9:
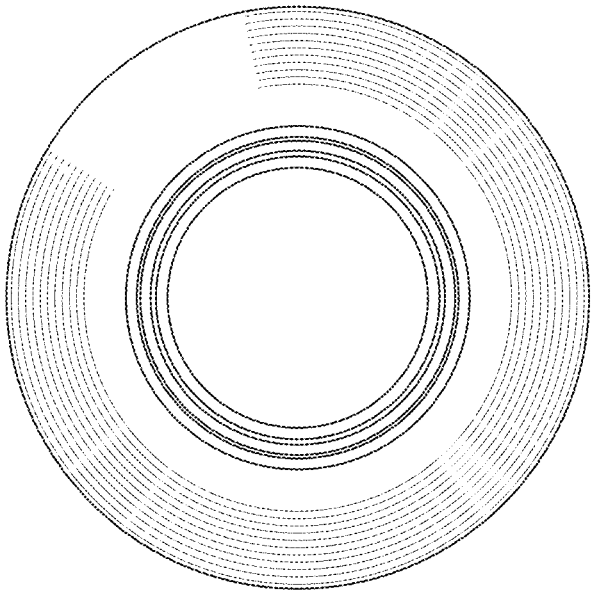
FIG. 9 is a top view of the container of FIG. 7.
Figure 10:
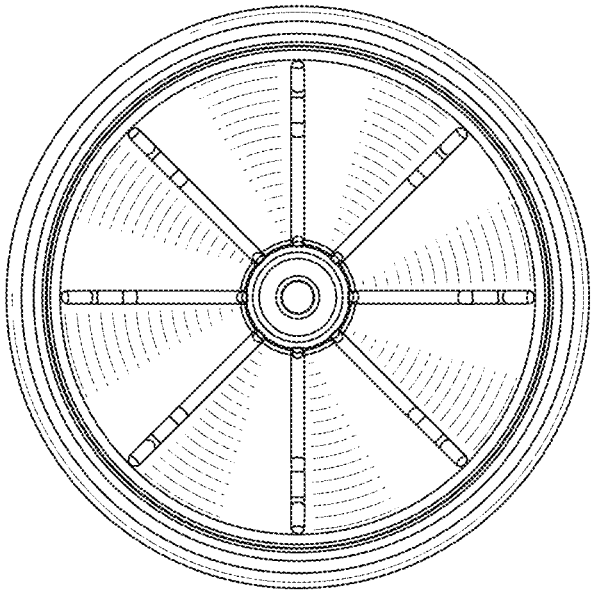
FIG. 10 is a bottom view of the container of FIG. 7.

With reference to FIG. 8, an alternative exemplary embodiment of a container in accordance with the disclosed subject matter is depicted. As embodied herein, a first continuous rib 701 can be vertically spaced from a second continuous rib 702 such that a top edge of each top branch 504 of the first continuous rib 701 defines a first horizontal plane, and a bottom edge of each bottom branch 505 of the second continuous rib 702 defines a second horizontal plane. As embodied herein, the second horizontal plane can be spaced vertically from the first horizontal plane, and continuous groove 710 can extend about the outer perimeter of the sidewall 111 between the first and second horizontal planes. As further embodied herein, the container 700 can include a third continuous rib 703 vertically spaced from the second continuous rib 702. As such, a first vertical distance can be measured between a midpoint of each horizontal segment 203 of the second continuous rib 702 and midpoint of each corresponding top branch 504 of the first continuous rib 701, and a second vertical distance can be measured between a midpoint of each horizontal segment 203 of the second continuous rib 702 and a midpoint of each corresponding bottom branch 505 of the third continuous rib 703. As embodied herein, the first vertical distance can be different from the second vertical distance. Containers in accordance with the disclosed subject matter can have any suitable number of continuous grooves 710, which can extend about the outer perimeter of the sidewall 111. Additionally, and in accordance with the disclosed subject matter, vertical spacing between continuous ribs 201 can be selected such that the spacing between one pair of adjacent continuous ribs 201 can be different from the vertical spacing between a second pair of adjacent continuous ribs 201.

Figure 6B:
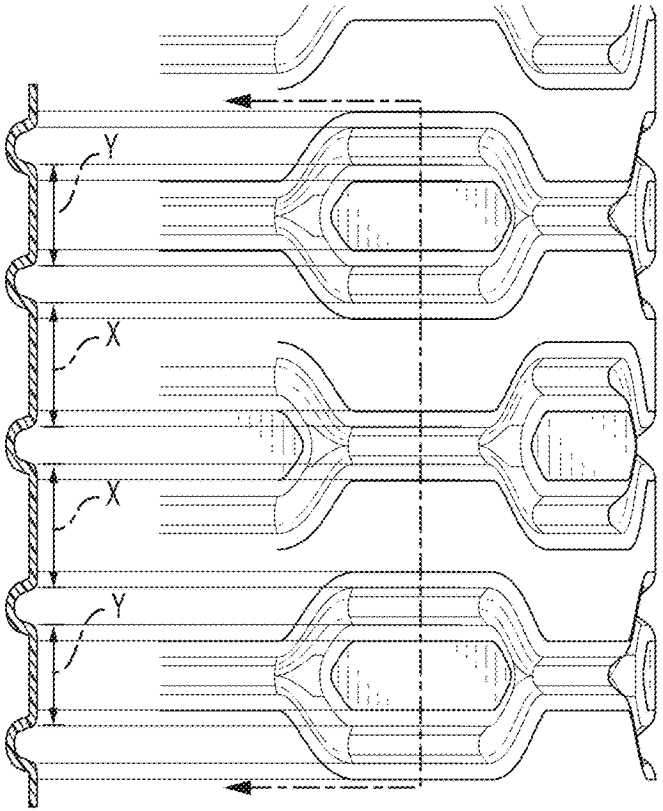
FIG. 6B depicts the partial cross-sectional view of FIG. 6A overlaid with a corresponding side view of the container of FIG. 1 for purpose of illustration.
Figure 6A:
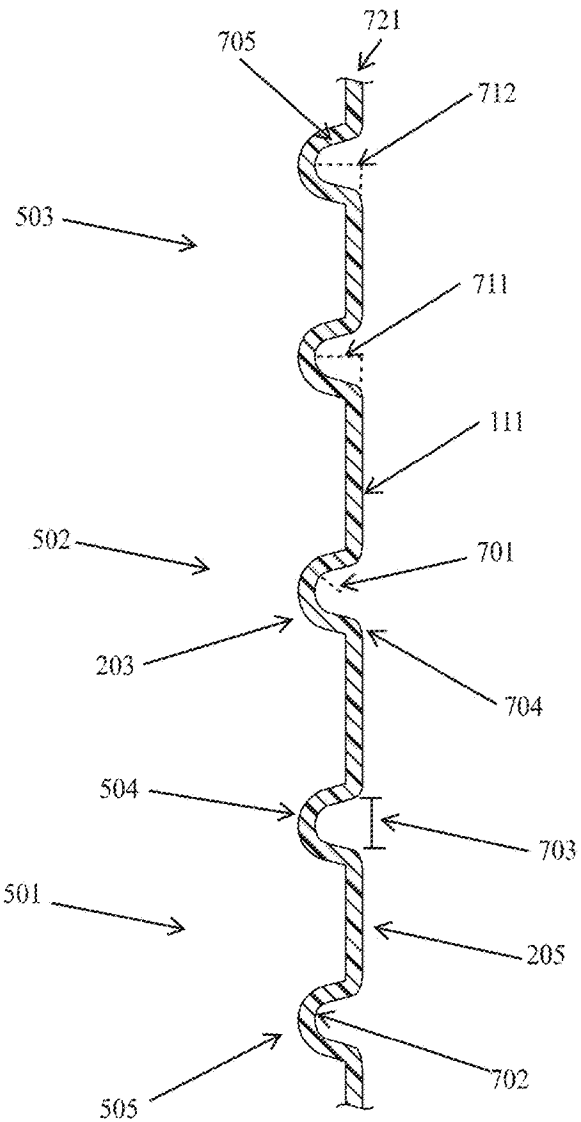
FIG. 6A is an enlarged partial cross-sectional view of the container of FIG. 1 taken along line 6A-6A as referenced in FIG. 2.
Figure 7:
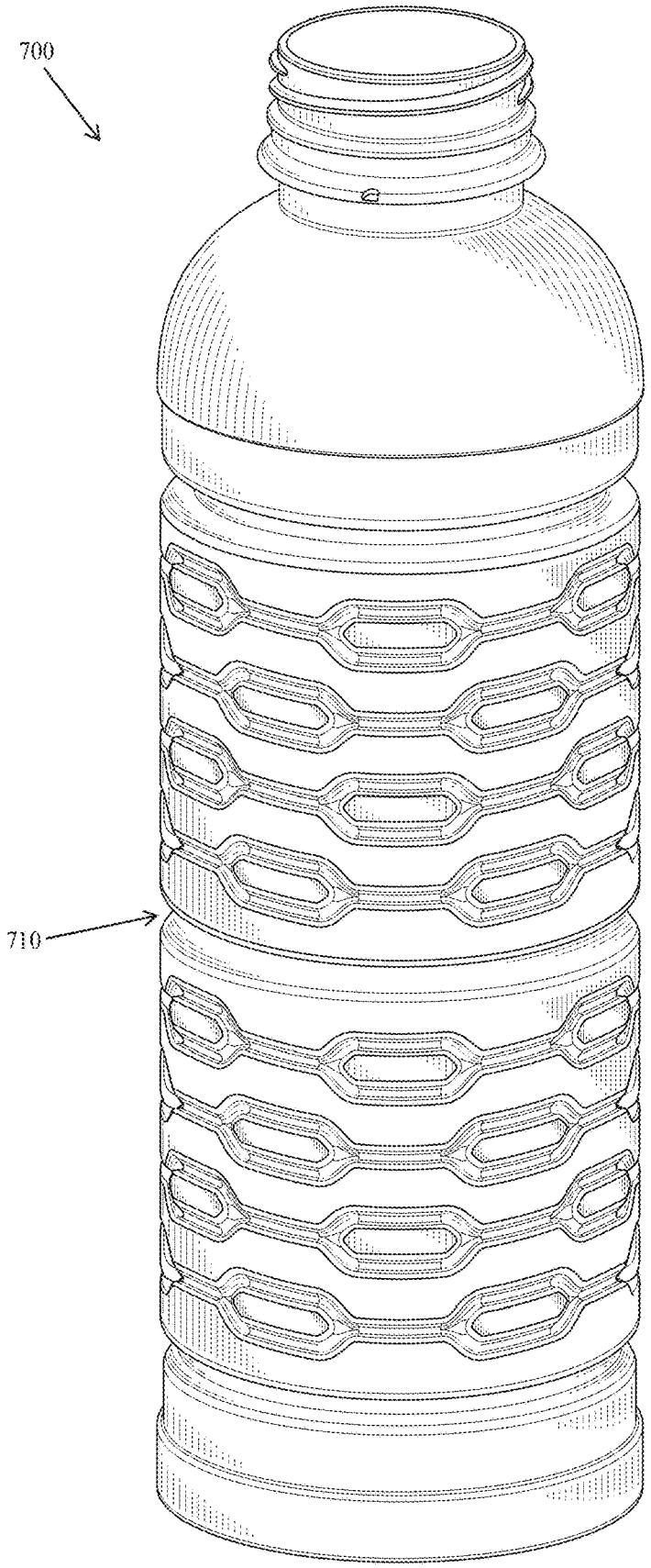
FIG. 7 is a side perspective view of an alternative exemplary embodiment of a container in accordance with the disclosed subject matter.

For purpose of illustration and not limitation, reference is now made to FIG. 6A, which depicts an enlarged cross-sectional view of a portion of the sidewall 111 of container 100 along line 6A-6A of FIG. 2. As depicted in FIG. 6A, a first continuous rib 501, a second continuous rib 502, and a third continuous rib 503 are shown in cross-section. For example, and without limitation, continuous ribs 201 can have any suitable shape in side cross-section, such as a partial oval shape, rectangular shape, triangular shape, square shape, or any other suitable shape. Additionally, or alternatively, and as embodied herein, continuous ribs 201 can define a concave channel in side cross-section relative to an exterior of the perimeter of the container 100. Furthermore, and as embodied herein, such concave continuous ribs 201 can have a radius 701 in side cross section which can define a nadir 702, or low point, relative the sidewall 111 of the container 100. A depth 711 of each continuous rib 201 can be measured from the outer perimeter of the sidewall 111 to the nadir of each continuous rib 201. For example, depth 711 of the continuous rib 201 can be substantially equal to radius 701. Additionally, or alternatively, depth 711 can be larger or smaller than radius 701 depending on the shape and configuration of continuous rib 201. As embodied herein, depth 711 can be uniform around the circumference of the container 100. In accordance with another aspect of the disclosed subject matter, depth 711 can be varied around the circumference of the container 100. Additionally, and as embodied herein, each continuous rib 201 can have a width 703 in side cross-section or profile. Width 703 can be approximately equal to twice the radius 701 of the continuous rib 201 or different than such dimension. The radius 701 of continuous ribs 201 can be provided with dimensions suitable for the size of the container and desired properties. For purpose of example, and not limitation, the radius 701 can be between approximately 0.020 inches and 0.080 inches for a container with a diameter of approximately 3 inches. Likewise, the dimensions of the depth and width of the continuous ribs 201 can be selected for the desired properties and size of the container. For example, ribs of larger dimensions can be provided for a container with a larger diameter. Also, if the radius 701 of continuous rib 201 is larger, the width and/or depth of the continuous rib 201 can increase.

As further depicted in FIG. 6A, continuous ribs 201 can also include transition portions 704 between the sidewall 111 of the container 100 and the inner wall 705 of the continuous ribs 201. As embodied herein, transition portions 704 can include a curved portion in side cross-section with an appropriate radius selected to transition between the sidewall 111 and the inner wall 705 of the continuous rib.

Further in accordance with the disclosed subject matter, each pair of top branch 504 and bottom branch 505 of the branched segments 204 of the continuous ribs 201 defines bounded areas 205 therebetween. For purpose of illustration, and as depicted in FIGS. 5 and 6A, two bounded areas 205 are shown between the visible top branches 504 and the visible bottom branches 505 of first continuous rib 501 and third continuous rib 503, respectively. As embodied herein, continuous ribs 201 can have a second depth 712 measured from the nadir 702 of the continuous ribs 201 to the exterior surface of the corresponding bounded area 205. The second continuous rib depth 712 measured relative the corresponding bounded area 205 can be substantially equal to the first continuous rib depth 711 measured relative the sidewall 111. In such embodiments, the bounded areas 205 and the sidewall 111 can be substantially within the same plane or circumference in cross-section. Alternatively, the second depth 712 can be different, i.e., larger or smaller, than the first depth 711, such that the bounded areas 205 can be raised relative to the sidewall 111 or recessed relative the sidewall 111, respectively.

While the above discussion refers to continuous ribs 201 as recessed within the sidewall 111 and bounded areas 205, containers in accordance with the disclosed subject matter can include continuous ribs 201 raised or extending outwardly relative the adjacent sidewall 111 and bounded areas 205. In such embodiments the continuous ribs 201 can have similarly suitable shapes, as described above, so as to have heights measured from the sidewall 111 and bounded areas, respectively.

As further embodied herein, sidewall 111 of container 100 can have a thickness 721. As will be recognized by those skilled in the art, the sidewall thickness 721 of containers according to the disclosed subject matter can be generally uniform, or can be varied across different portions of the sidewall depending on the properties of the material used to make the container and the method of manufacture used. For example, and as embodied herein, a blow molded plastic container 100 can have an average sidewall thickness of between approximately 0.008 inches to approximately 0.017 inches for a container with a capacity of 20 fluid ounces. As further embodied herein, container 100 can have a weight of between approximately 24 grams to approximately 35 grams for a container with a capacity of 20 fluid ounces depending on the properties of the material used to make the container and the method of manufacture used. As will be understood by those in the art, the average sidewall thickness and the weight of container 100 can vary with the size of the container, such that a container with a greater capacity can have increased average sidewall thickness and increased weight.

Figure 4:
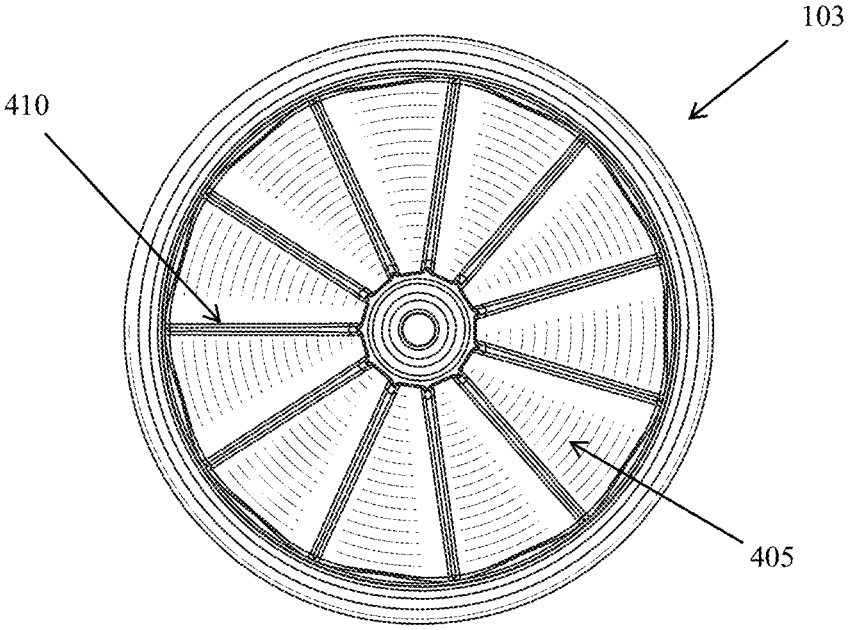
FIG. 4 is a bottom view of the container of FIG. 1.

As further embodied herein, container 100 includes a bottom portion 103 disposed below body portion 102 opposite top portion 101 and extending from a lower end of the body portion 102. FIG. 4 depicts a bottom view of a bottom portion of container 100 in accordance with the disclosed subject matter. Bottom portion 103 includes a base 405 which defines a horizontal support surface. Containers in accordance with the disclosed subject matter can include bottom portions 103 with any of a variety of suitable configurations. For example, and as embodied herein, bottom portion 103 can have a plurality of ribs 410 extending radially from the center of base 405 to the exterior perimeter of bottom portion 103 if desired for strength and performance. Additionally, or alternatively, the container can include a vacuum base configured to flex downwardly in a controlled manner and to a desired extent when pressure within the container is elevated, and to flex upwardly in a controlled manner and to a desired extent when a vacuum develops within the filled and sealed container. For purpose of example, and without limitation, containers in accordance with the disclosed subject matter can be provided with bottom portions 103 with configurations as disclosed in U.S. Pat. Nos. 6,612,451, 7,980,404, 8,381,496, 8,529,975, 8,839,972, and/or 9,522,749, each of which is incorporated by reference herein in its entirety.

In accordance with another aspect of the disclosed subject matter, a method of making and of using a container 100 of the disclosed subject matter is provided. That is, it will be understood that the container having the various features as disclosed can be made using any suitable technique, including blow molding, extrusion blow molding, single stage polyethylene terephthalate, two stage polyethylene terephthalate, etc. For example, and without limitation, the disclosed containers can be made by the methods disclosed in U.S. Pat. Nos. 8,636,944, 8,585,392, 8,632,867, 8,535,599, 8,544,663, and 8,556,621, each of which is incorporated by reference herein in its entirety. The container can be made from any suitable polymeric materials, including but not limited to low and high-density polyethylene, polyethylene terephthalate, polyethylene naphthalate ("PEN"), PEN blends, polyvinyl chloride, polypropylene, polystyrene, fluorine treated high density polyethylene, post-consumer resin, K-resin, bioplastic, catalytic scavengers, including monolayer-blended scavengers, multi-layer structures, or a mixture, blend, or copolymer thereof. Likewise, the containers disclosed herein can be hot-filled, sealed, and cooled using a suitable process. For purpose of example and not limitation, containers in accordance with the disclosed subject matter can be hot-filled with liquids at temperatures between 68° C.-101° C. (155° F.-214° F.) and usually about 85° C. (185° F.).

Figure 12:
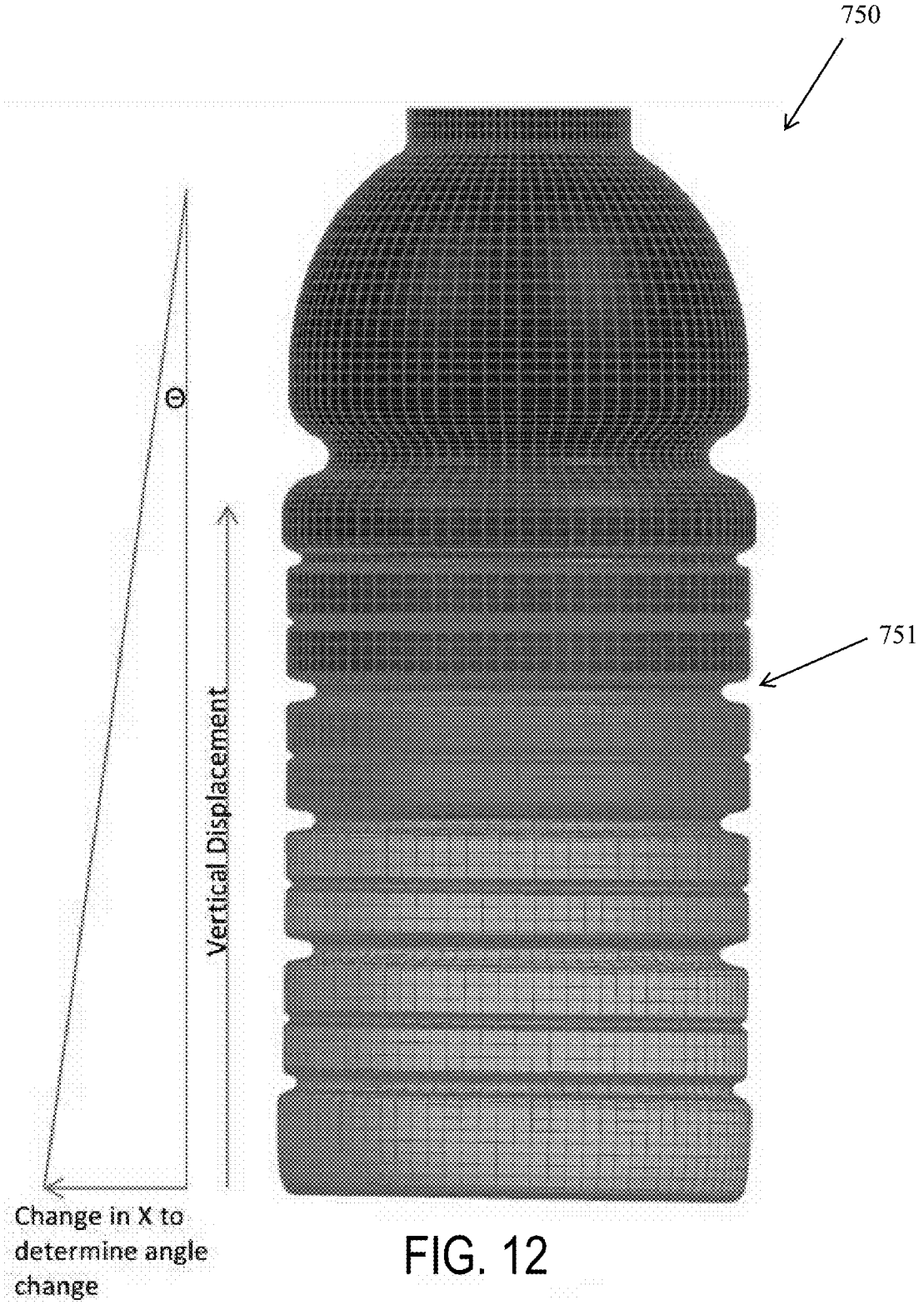
FIG. 12 is a side view of a computer simulated example of a container having a traditional hoop design with shading to indicate vertical displacement of the sample container under vacuum.

The containers of the disclosed subject matter have demonstrated desired performance characteristics not achieved by conventional hoop-ring containers or the like. For purpose of understanding and not limitation, data is provided to demonstrate various operational characteristics achieved by the containers disclosed herein. For purpose of illustration and comparison, computer simulation using a finite element analysis software was performed to compare the characteristics of an exemplary container in accordance with the disclosed subject matter to the characteristics of a container of similar size and construction, but with a traditional hoop-ring design. With reference to FIG. 12, a computer-simulated model of a blow-molded container 750 is shown with a traditional hoop-ring design comprising a plurality of hoops 751 extending about the perimeter of the sidewall of the container. As shown here for comparison, the conventional hoop-style container 750 has a capacity of 20 fluid ounces and an average wall thickness of 0.012 inches.

When subjected to internal vacuum forces, the conventional hoop-style container 750 was observed to deform in the vertical direction. For example, stresses can concentrate in hoops 751 when the container 750 is subjected to vacuum forces, and the stress concentrations cause hoops 751 to deform or compress vertically such that the overall height of the hoop-style container 750 decreases. Additionally, such stresses under vacuum conditions are observed to be unevenly distributed in the traditional hoop-style container 750 such that the container deforms vertically more in certain areas of the sidewall than others. This uneven distortion can cause the container to bend or lean under vacuum such that the container sidewall moves or bends transverse to a vertical axis of the container. Such negative pressures in the hoop-style container therefore can result in undesired deformation of the container which can lead to an aesthetically unacceptable container, and/or compromised performance, including reduced strength, e.g. hoop strength and axial load, as well as instability. Furthermore, containers with decreased wall thickness can be desirable for material and weight savings, but the likelihood and/or the amount of deformation can increase as the average wall thickness of the container is decreased.

To model the behavior characteristics of an exemplary embodiment of a hoop-style container 750, a vacuum pressure was simulated within the hoop-style container 750, as depicted in FIG. 12. Vertical displacement of the container and perpendicularity were then measured to observe the behavior of hoop-style container 750 under vacuum conditions. Vertical displacement was calculated as the change in height of the hoop-style container 750 as a result of the vacuum pressure within the container 750. Perpendicularity was calculated by measuring the horizontal displacement of the hoop-style container 750 in the X direction in order to calculate the angle Θ as depicted in FIG. 12.

Figure 13:
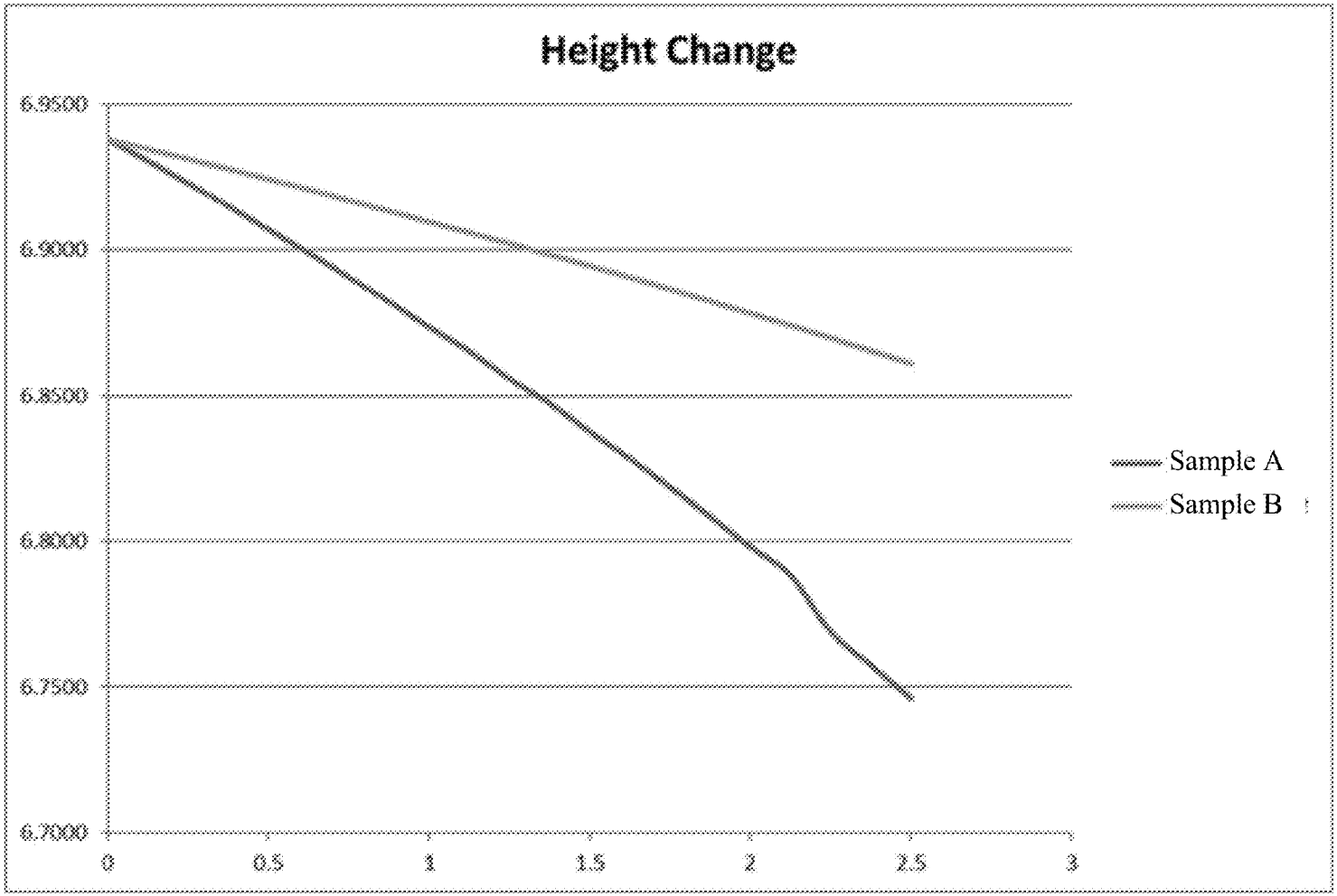
FIG. 13 is a chart depicting the height change under vacuum of the sample container of FIG. 12 compared to the height change of a computer simulated sample container of FIG. 1 in accordance with the disclosed subject matter.
Figure 14:
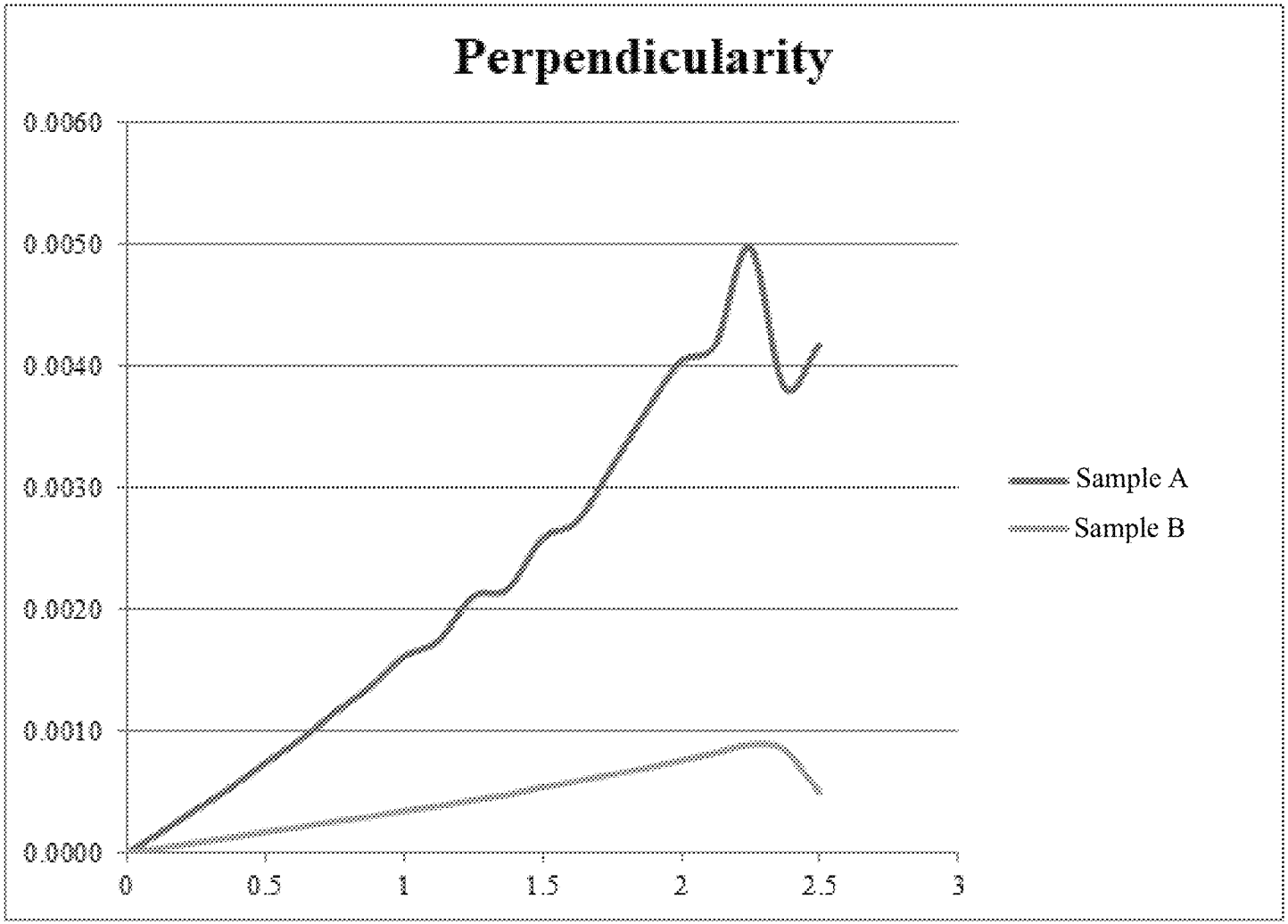
FIG. 14 is a chart depicting the perpendicularity under vacuum of the sample container of FIG. 12 compared to the perpendicularity of a computer simulated sample container of FIG. 1 in accordance with the disclosed subject matter.

For purpose of understanding and not limitation, FIGS. 13 & 14 illustrate the simulated performance of the hoop-style container 750 with a traditional hoop design as compared to a sample container according to the disclosed subject matter. For purpose of comparison, the containers were of similar size and construction. With reference to FIGS. 13 & 14, Sample A represents simulated hoop-style container 750 having a capacity of 20 fluid ounces and an average wall thickness of 0.012 inches with a traditional hoop-ring design. Wherein, Sample B represents a simulated container similar to the representative embodiment of FIGS. 1-6B according to the disclosed subject matter. The container of Sample B has a capacity of 20 fluid ounces, an average wall thickness of 0.012 inches, and a plurality of continuous ribs in accordance with the disclosed subject matter. For purpose of example and not limitation, the continuous ribs of the container of Sample B have a first depth relative to the sidewall 111 of the container of approximately 0.040 inches.

FIG. 13 depicts the height of Sample A and Sample B measured in inches on the Y axis as the containers are subjected to increasing vacuum pressures, as measured in pounds per square inch ("PSI") on the X axis. As depicted in FIG. 13, Sample B according to the disclosed subject matter exhibits less vertical deformation, and thus less height change, than Sample A. For example, at a vacuum pressure of 2 PSI, Sample A exhibits a height change of approximately 0.140 inches while sample container B exhibits a height change of approximately 0.060 inches. Additionally, FIG. 14 depicts the perpendicularity of Sample A and Sample B measured in degrees on the Y axis as the containers are subjected to increasing vacuum pressures, as measured in PSI on the X axis. As depicted in FIG. 14, Sample B according to the disclosed subject matter exhibits less displacement in the X direction, and thus less perpendicularity, than Sample A. For example, at 2 PSI, Sample A exhibits a perpendicularity of approximately 0.004 degrees while sample container B exhibits a perpendicularity of approximately 0.0008 degrees.

Accordingly, containers according to the disclosed subject matter can exhibit reduced undesirable or uncontrolled deformation compared to traditional containers having the same sidewall thickness and material weight without compromising performance.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

The invention claimed is:

1. A container comprising:

a body portion comprising a sidewall defining an outer perimeter and a hollow interior;

a bottom portion extending from a lower end of the body portion, the bottom portion defining a horizontal support surface; and a top portion extending from an upper end of the body portion opposite the bottom portion, the top portion comprising a finish portion, wherein the body portion comprises a plurality of continuous ribs extending about the outer perimeter of the sidewall, each continuous rib having alternating horizontal segments and branched segments, each branched segment having a top branch and a bottom branch joined at either end to define a bounded area therebetween;

wherein the plurality of continuous ribs includes at least a first continuous rib and a second continuous rib, the second continuous rib spaced vertically from the first continuous rib, and further wherein a midpoint of each branched segment of the first continuous rib is aligned along a vertical axis with a midpoint of a corresponding horizontal segment of the second continuous rib, and a midpoint of each horizontal segment of the first continuous rib is aligned along a vertical axis with a midpoint of a corresponding branched segment of the second continuous rib; and wherein a top edge of each top branch of the first continuous rib defines a first horizontal plane, and a bottom edge of each bottom branch of the second continuous rib defines a second horizontal plane, the second horizontal plane being spaced vertically from the first horizontal plane.

2. The container of claim 1, wherein the second horizontal plane is above the first horizontal plane.

3. The container of claim 2, wherein the body portion further comprises a continuous groove extending about the outer perimeter of the sidewall between the first horizontal plane and the second horizontal plane.

4. The container of claim 1, wherein a distance between the first horizontal plane and the second horizontal plane is approximately 0.040 inches to approximately 0.090 inches.

5. The container of claim 1, wherein a first vertical distance between a midpoint of each top branch of the first continuous rib and a midpoint of a corresponding horizontal segment of the second continuous rib is substantially equal to a second vertical distance between a midpoint of each horizontal segment of the first continuous rib and a midpoint of a corresponding bottom branch of the second continuous rib.

6. The container of claim 5, wherein the first vertical distance is approximately 0.280 inches to approximately 0.420 inches.

7. The container of claim 1, further comprising a third continuous rib, wherein a first vertical distance between a midpoint of each horizontal segment of the second continuous rib and a midpoint of a corresponding top branch of the first continuous rib is substantially equal to a second vertical distance between the midpoint of each horizontal segment of the second continuous rib and a midpoint of a corresponding bottom branch of the third continuous rib.

8. The container of claim 1, wherein the body portion comprises between 3 and 12 continuous ribs.

9. The container of claim 1, wherein each bounded area has a shape selected from the group consisting of, circular, oval, eye-like, rectangular, square, hexagonal, and octagonal.

10. The container of claim 1, wherein each continuous rib comprises between 4 and 12 branched segments and a corresponding number of horizontal segments.

11. The container of claim 1, wherein each continuous rib defines a concave channel in side cross-section relative an exterior of the perimeter.

12. The container of claim 11, wherein each channel has a nadir having a first depth relative the sidewall.

13. The container of claim 12, wherein the first depth is between approximately 0.020 inches and approximately 0.080 inches.

14. The container of claim 12, wherein each nadir has a second depth relative the bounded area.

15. The container of claim 14, wherein the second depth is substantially equal to the first depth.

16. The container of claim 1, wherein the container comprises a blow-molded container.

17. The container of claim 1, wherein the container body portion has a wall thickness of approximately 0.008 inches to approximately 0.017 inches.

18. The container of claim 1, wherein the container is made from a material selected from the group consisting of low and high-density polyethylene, polyethylene terephthalate, polyethylene naphthalate, polyethylene naphthalate blends, polyvinyl chloride, polypropylene, polystyrene, fluorine treated high density polyethylene, post-consumer resin, K-resin, bioplastic, catalytic scavengers, including monolayer-blended scavengers, multi-layer structures, or a mixture, blend, or copolymer thereof.

19. The container of claim 1, wherein the bottom portion includes a vacuum base.

20. A container comprising:

a body portion comprising a sidewall defining an outer perimeter and a hollow interior;

a bottom portion extending from a lower end of the body portion, the bottom portion defining a horizontal support surface; and a top portion extending from an upper end of the body portion opposite the bottom portion, the top portion comprising a finish portion, wherein the body portion comprises a plurality of continuous ribs extending about the outer perimeter of the sidewall, each continuous rib having alternating horizontal segments and branched segments, each branched segment having a top branch and a bottom branch joined at either end to define a bounded area therebetween;

wherein the plurality of continuous ribs includes at least a first continuous rib and a second continuous rib, the second continuous rib spaced vertically from the first continuous rib, and further wherein a midpoint of each branched segment of the first continuous rib is aligned along a vertical axis with a midpoint of a corresponding horizontal segment of the second continuous rib, and a midpoint of each horizontal segment of the first continuous rib is aligned along a vertical axis with a midpoint of a corresponding branched segment of the second continuous rib;

wherein each branched segment comprises at least one linear section aligned parallel to each horizontal segment; and wherein a length of each linear section is substantially equal to a length of each horizontal segment.

21. A container comprising:

a body portion comprising a sidewall defining an outer perimeter and a hollow interior;

a bottom portion extending from a lower end of the body portion, the bottom portion defining a horizontal support surface; and a top portion extending from an upper end of the body portion opposite the bottom portion, the top portion comprising a finish portion, wherein the body portion comprises a plurality of continuous ribs extending about the outer perimeter of the sidewall, each continuous rib having alternating horizontal segments and branched segments, each branched segment having a top branch and a bottom branch joined at either end to define a bounded area therebetween;

wherein the plurality of continuous ribs includes at least a first continuous rib and a second continuous rib, the second continuous rib spaced vertically from the first continuous rib, and further wherein a midpoint of each branched segment of the first continuous rib is aligned along a vertical axis with a midpoint of a corresponding horizontal segment of the second continuous rib, and a midpoint of each horizontal segment of the first continuous rib is aligned along a vertical axis with a midpoint of a corresponding branched segment of the second continuous rib; and wherein the container has a total weight of approximately 24 grams to approximately 35 grams.

* * * * *